US006764252B2

(12) United States Patent
Banting

(10) Patent No.: US 6,764,252 B2
(45) Date of Patent: Jul. 20, 2004

(54) RETAINING WALL SYSTEM

(76) Inventor: Murray Sinclair Banting, P.O. Box 1053, Bragg Creek Alberta (CA), T0L 0K0

( * ) Notice: Subject to any disclaimer, the term of this patent is extended or adjusted under 35 U.S.C. 154(b) by 0 days.

(21) Appl. No.: 10/065,214

(22) Filed: Sep. 26, 2002

(65) Prior Publication Data

US 2004/0062613 A1 Apr. 1, 2004

(51) Int. Cl.[7] ..... E02D 29/02
(52) U.S. Cl. ..... 405/262; 405/284
(58) Field of Search ..... 405/284, 285, 405/286, 262

(56) References Cited

U.S. PATENT DOCUMENTS

| | | | | |
|---|---|---|---|---|
| 2,638,188 A | | 5/1953 | Corn | 189/34 |
| 4,117,686 A | * | 10/1978 | Hilfiker | 405/284 |
| 4,856,939 A | * | 8/1989 | Hilfiker | 405/284 |
| 5,156,496 A | | 10/1992 | Vidal et al. | 405/262 |
| 5,161,917 A | * | 11/1992 | Papetti | 405/284 |
| 5,531,547 A | | 7/1996 | Shimada | 405/258 |
| 5,733,072 A | * | 3/1998 | Hilfiker et al. | 405/284 |
| 6,296,422 B1 | | 10/2001 | Ferraiolo | 405/262 |

* cited by examiner

*Primary Examiner*—Frederick L. Lagman

(57) ABSTRACT

A retaining wall system having at least one wall section. Each wall section including a base, retaining face and a hinge. The base having a front, rear and sides. The retaining face having a top, bottom and sides. The hinge connecting the front of the base to the bottom of the retaining face. Whereby the hinge allows the retaining face to be folded to and from the base. The retaining face includes an open grid pattern between the top, bottom and sides. The wall section further includes a plurality of receiving elements on each of the sides of both the base and retaining face to allow different angle settings between the base and retaining face. A brace is connected to one of the receiving elements on the base and one of the receiving elements on the retaining face on each side of the wall section between the base and retaining face.

14 Claims, 12 Drawing Sheets

RETAINING WALL SYSTEM

BACKGROUND OF INVENTION

The present invention generally relates to retaining walls used in landscaping for holding back earth, such as soil and rocks. More specifically, the present invention relates to a retaining wall system to form a retaining wall, which is stackable, porous and adjustable.

The most common form of retaining walls is a series of interlocking bricks or concrete blocks. Treated wooden beams, fabric, fabric netting and metal linked fabric are other common materials used to create a retaining wall. Many of methods of using these materials have the disadvantages of great weight, deterioration or the inability to be used to create varying degrees of grade on the face of the retaining wall. There are netting systems used as retaining walls, which can be stacked and angled. The netting systems usually include a wire netting, which needs to be attached to tubing frame by the user. The assembly, setup and stacking of these netting systems as a retaining wall can be quite cumbersome and even difficult for the user, especially the do-it-yourself user. What is needed is a system that is out of the box ready to be used and easy to setup for all users.

It is an object of the present invention to provide retaining wall system that is easy to assemble and setup.

It is an object of the present invention to provide retaining wall system that is stackable.

It is an object of the present invention to provide retaining wall system that is porous to allow plant life to grow out from the retaining wall system.

SUMMARY OF INVENTION

A retaining wall system having at least one wall section. Each wall section including a base, retaining face and a hinge. The base having a front, rear and sides. The retaining face having a top, bottom and sides. The hinge connecting the front of the base to the bottom of the retaining face. Whereby the hinge allows the retaining face to be folded to and from the base. The retaining face includes an open grid pattern between the top, bottom and sides. The wall section further includes a plurality of receiving elements on each of the sides of both the base and retaining face to allow different angle settings between the base and retaining face. A brace is connected to one of the receiving elements on the base and one of the receiving elements on the retaining face on each side of the wall section between the base and retaining face.

DETAILED DESCRIPTION

The present invention is a retaining wall system 10, as shown in FIGS. 1–12. The retaining wall system 10 is used to hold back an embankment of earth or could be used to restrict the flow of water, blowing snow or blowing sand. The retaining wall system 10 is an alternative to conventional retaining wall structures. The retaining wall system 10 is a light weight and inexpensive retention system and offers ease of assembly and setup. The retaining wall system 10 is used to create an aesthetically pleasing and environmentally friendly retaining wall. The retaining wall system 10 can be easily adjusted to match the degree of steepness required for the retaining wall. Currently available systems require precise placement and expert installation, and can also required specialized equipment and heavy labor. The placement of the system is not as critical with the retaining wall system 10 of the present invention, since vegetation covers the completed wall making smaller irregularities in the installation invisible. The retaining wall system 10 can be made of many materials, one of the preferred materials is composed of UV stabilized Polypropylene. The use of plastics such as Polypropylene allows the retaining wall system 10 to be light weight and user-friendly. The retaining wall system 10 allows the end user to install the retaining wall system 10 without the need for precision or heavy equipment.

Figure 3:
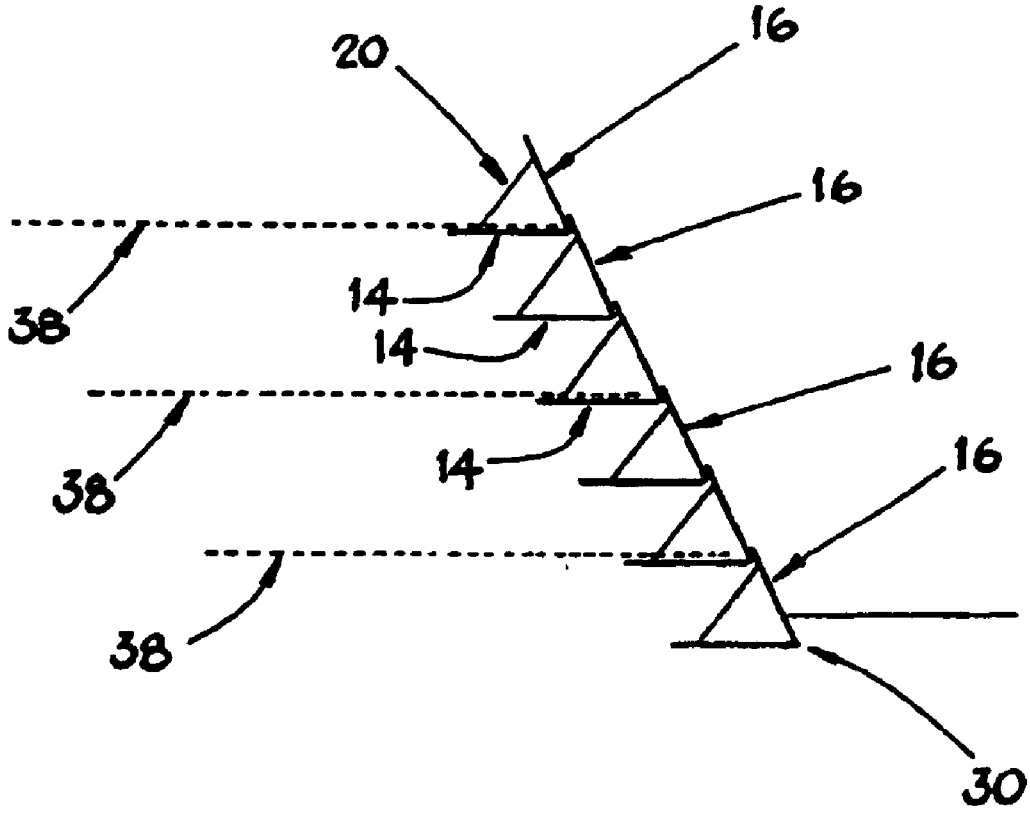
FIG. 3 is a side view of stacking wall sections according to the present invention.
Figure 4:
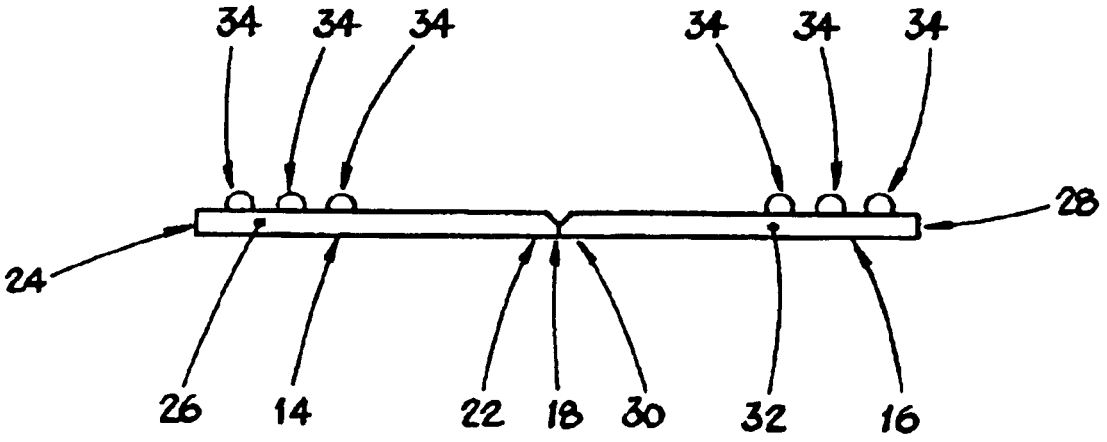
FIG. 4 is a side view of an unfolded wall section according to the present invention.
Figure 5:
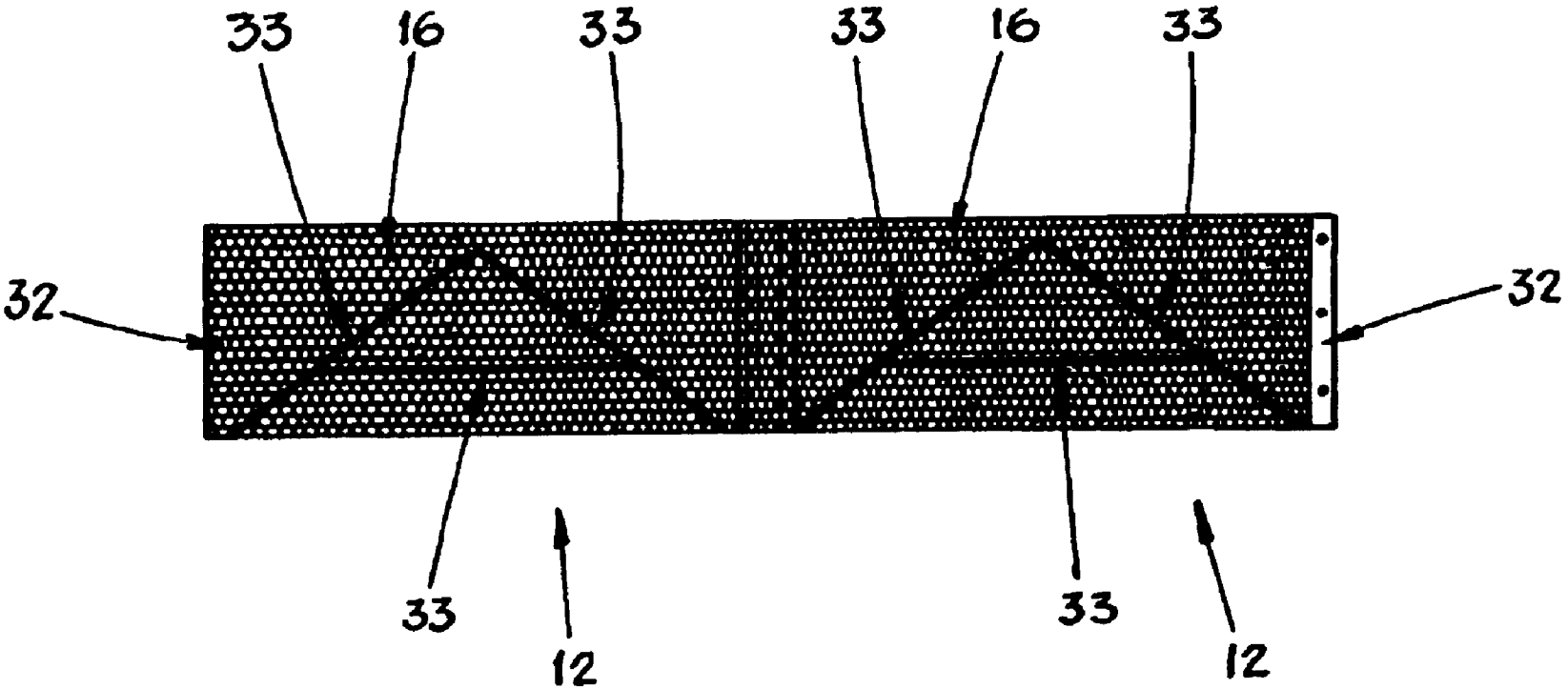
FIG. 5 is a front view of wall sections with reinforcing ribs according to the present invention.
Figure 6:
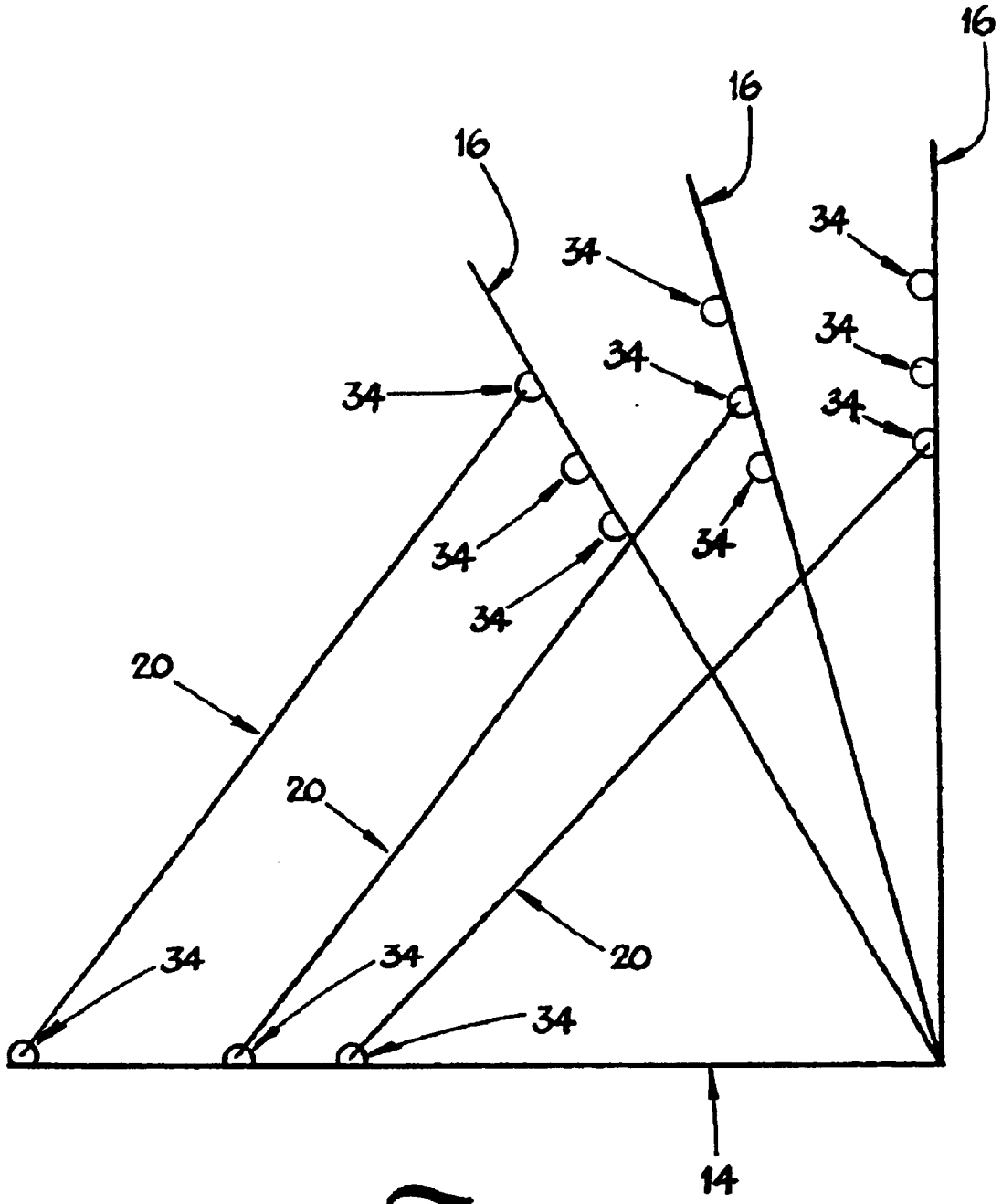
FIG. 6 is a side view of a wall section according to the present invention.
Figure 7:
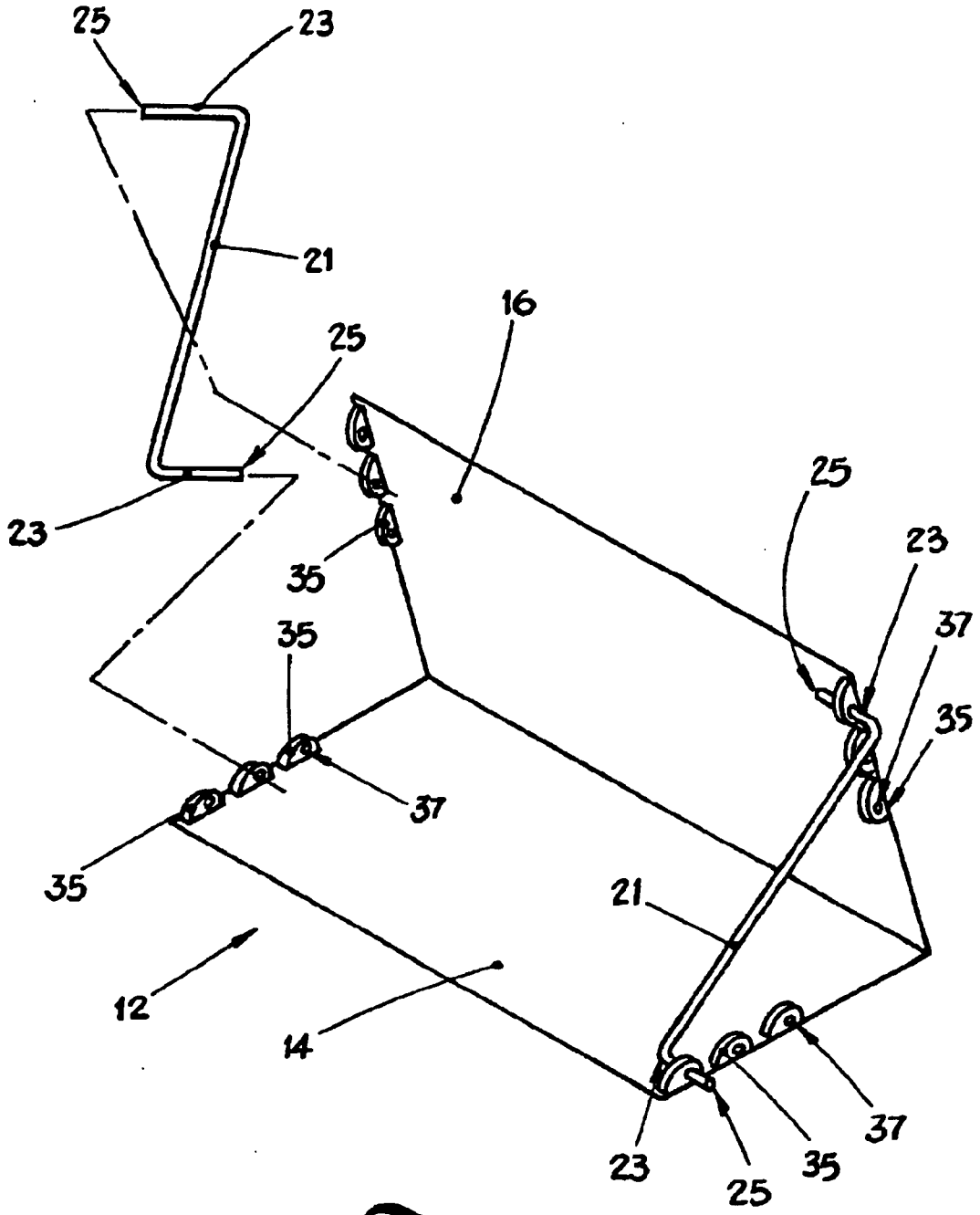
FIG. 7 is a rear perspective view of a wall section according to the present invention.

FIGS. 1–12 show the components and use of the retaining wall system 10 according to the present invention. The retaining wall system 10 includes one or more wall sections 12, as show in FIG. 1. The components of the wall sections 12 are made from an injection molded plastic for light weight, durability and ease of deployment. As shown in FIGS. 1–12, each wall section 12 includes a base 14, a retaining face 16, a hinge 18 and braces 20. The base 14 forms the bottom of each wall section 12. The base 14 is shown as a rectangle having a front 22, rear 24 and two sides 26. The base 14 can be a solid or open grid of material. The retaining face 16 forms the front of each wall section 12. The retaining face 16 is shown as a rectangle with an open grid pattern and having a top 28, bottom 30 and two sides 32. FIG. 5 show reinforcing ribs 33 within the open grid pattern of the retaining face 16. The reinforcing ribs 33 are thicker portions of the grid pattern formed during molding of the retaining face 16 for added strength. The bottom 30 of the retaining face 16 is connected to the front 22 of the base 14 using the hinge 18. If the base 14 and the retaining face 16 are molded as one piece of plastic, the hinge 18 can be as simple as a weak spot in the plastic to allow easy bending. There is a brace 20 mounted on each side of the wall section 12 between each side 26 of the base 14 and each side 32 of the retaining face 16 to lock the retaining face 16 in position. As schematically shown in FIG. 6, each side 26 of the base 14 and each side 32 of the retaining face 16 include receiving elements 34, which receive the ends 36 of each brace 20. FIG. 6 also shows a plurality of receiving elements 34 on the base 14 and retaining face 16 to allow the angle between the base 14 and the retaining face 16 to be adjustable. FIG. 6 shows some of the possible angle configurations of the retaining face 16 by placing brace 20 in the various receiving elements 34. The brace 20 and receiving elements 34 allow the user to easily vary the slope or grade of the retaining wall. FIG. 7 shows a specific example of a brace 20 and receiving elements 34. The brace 20 is a Z-shaped rod 21. The receiving elements 34 are eyelets 35 formed on the base 14 and the retaining face 16. The eyelets 35 include a hole 37 to receive ends 23 of the Z-shaped rod 21. One end 23 is pushed into the hole 37 of one of the eyelets 35 on the retaining face 16, while the other end 23 is pushed into the hole 37 of one of the eyelets 35 on the base 14. The Z-shape of the Z-shaped rod 21 prevents the ends 23 of the Z-shaped rod 21 from disengaging from the eyelets 35, once installed, due to a natural interlocking. Additionally, the tips 25 of the ends 23 can be formed of a thicker diameter as compared to the rest of the end 23 to frictionally retain the ends 23 in the eyelets 35. The brace 20 and receiving elements 34 do not necessarily need to be positioned directly at the sides 26, 32, but could be positioned somewhere between the sides 26, 32.

Figure 1:
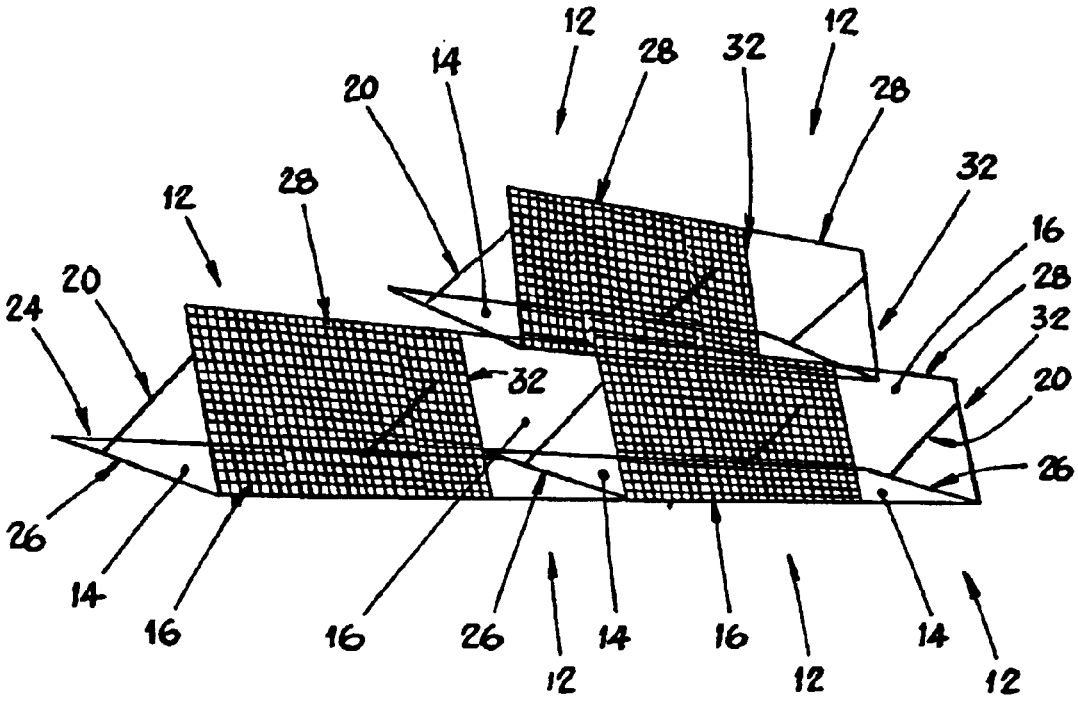
FIG. 1 is a perspective view of retaining wall system components according to the present invention.
Figure 2:
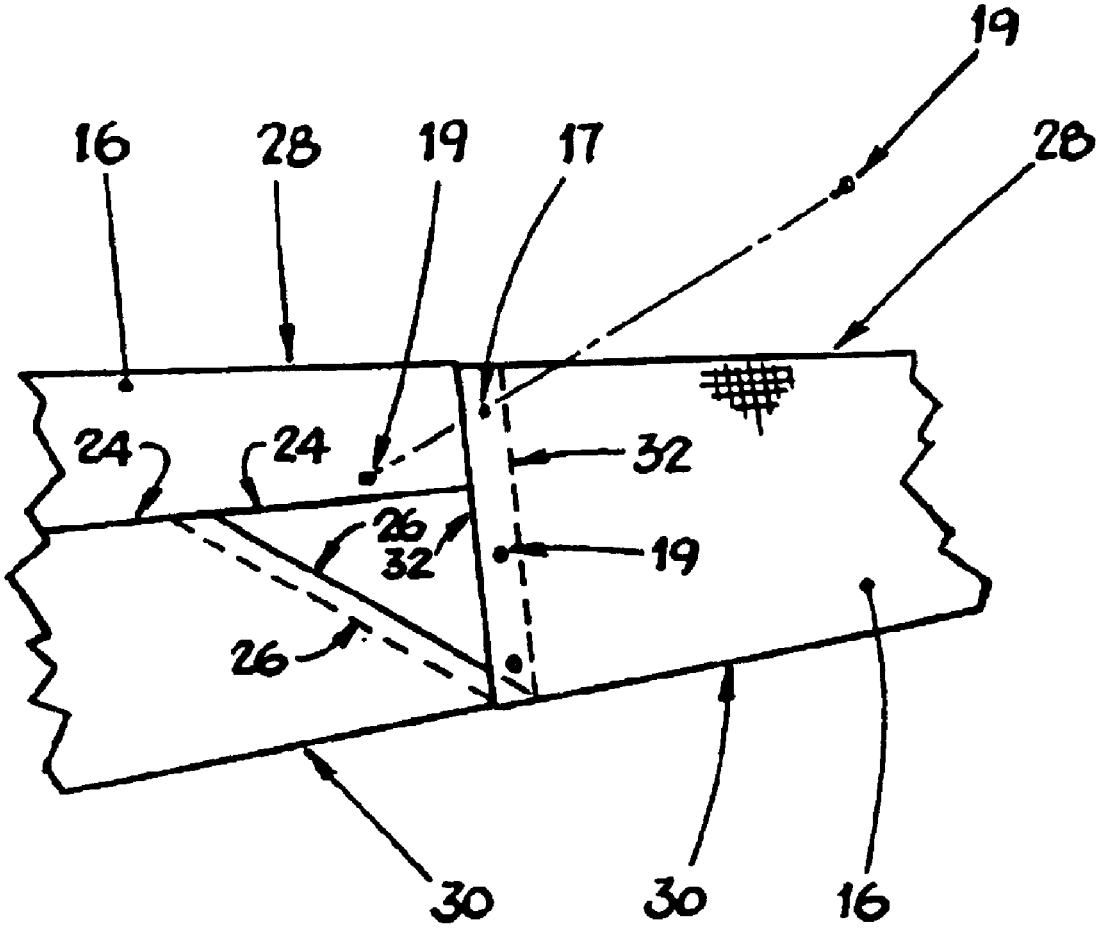
FIG. 2 is a perspective view of wall sections assembled together side-by-side according to the present invention.
Figure 8:
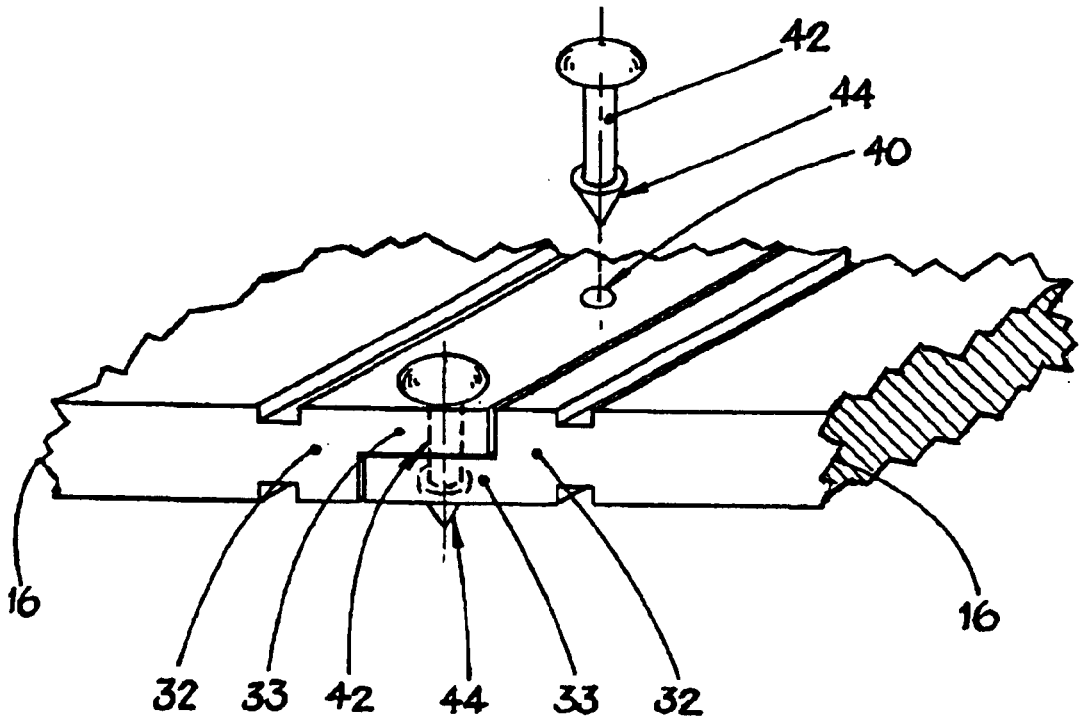
FIG. 8 is a perspective view of assembling sides of wall sections together according to the present invention.
Figure 9:
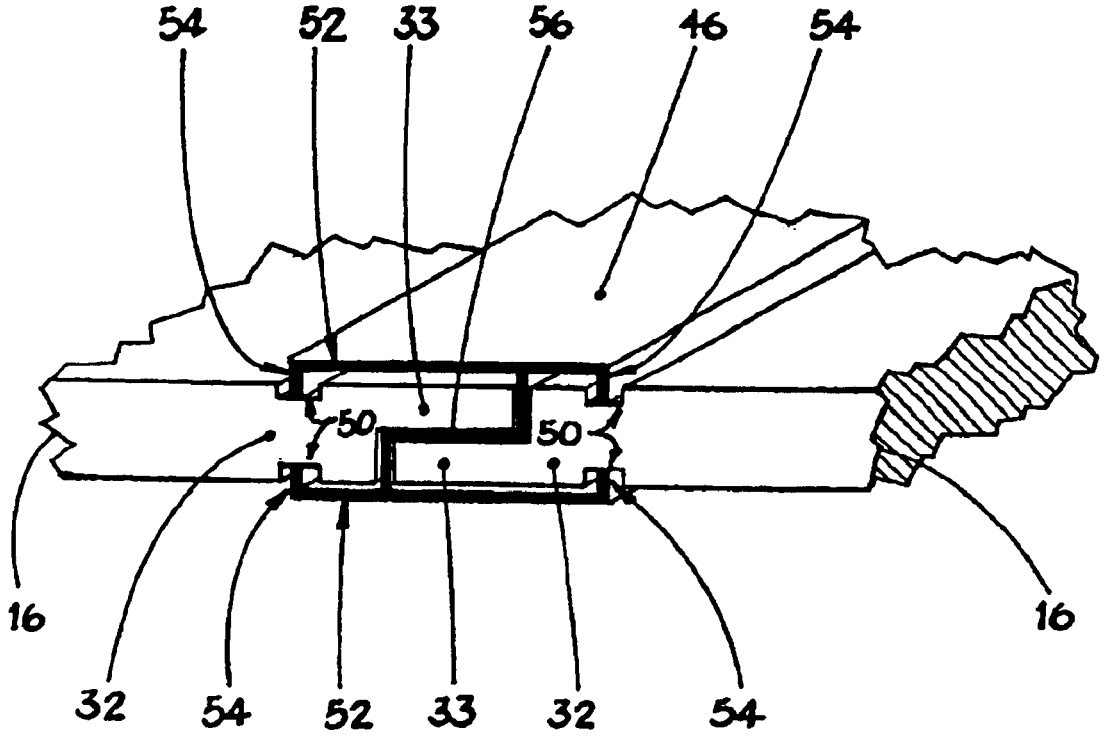
FIG. 9 is a perspective view of assembling sides of wall sections together according to the present Invention.

FIG. 1 shows a series of wall sections 12 assembled together. FIG. 4 shows a side view of a wall section 12 molded from one piece of material in its shipping configuration. In this position, the base 14 and retaining face 16 are joined by the hinge 18. To deploy the wall section 12, the user lifts the retaining face 16 upward towards the base 14 and bend the wall section 12 at the hinge 18. Then, the user fastens the braces 20 between the sides 26, 32 of the base 14 and the retaining face 16 using the receiving elements 34. As shown in FIGS. 6–7, the angle between the base 14 and retaining face 16 is set by choosing the proper receiving elements 34. To install each wall section 12, it is common to arrange one row of one or more wall sections 12 and backfill between the base 14 and retaining face 16 of each wall section 12 with earth. For strength, added rigidity and stability when backfilling, the wall sections 12 of each row can be fasten together at the sides 32 of the retaining faces 16, as shown in FIG. 2. Fastening can be done as shown in FIG. 2 by drilling holes 17 and using standard fasteners 19. FIGS. 8 and 9 show other alternatives for fastening the sides 32. As shown in FIGS. 8–9, the sides 32 can have an L-shaped edge 33 formed on the sides 32, such that the sides interlock with each other. FIG. 8 shows a version, whereby holes 40 are drilled and retaining plugs 42 are forced into the holes 40. The tip 44 of the retaining plug 42 should be flexible to allow insertion into the hole 40, yet rigid enough not to pull out once inserted. FIG. 9 shows an H-shaped retaining clamp 46, which runs the length of the sides 32. The sides 32 include grooves 50. The H-shaped retaining clamp 46 includes two sides 52, locking edges 54 and a cross-member 56. The cross-member 56 is profiled to fit between the L-shaped edges 33 on sides 32. The H-shaped retaining clamp 46 is flexible enough allow the sides 32 of the retaining faces 16 to be inserted between the sides 52 of the H-shaped retaining clamp 46. The L-shaped edges 33 naturally fit into the cross-member 56 and the locking edges 54 snap into the grooves 50 to retain the sides 32 together.

Figure 10:
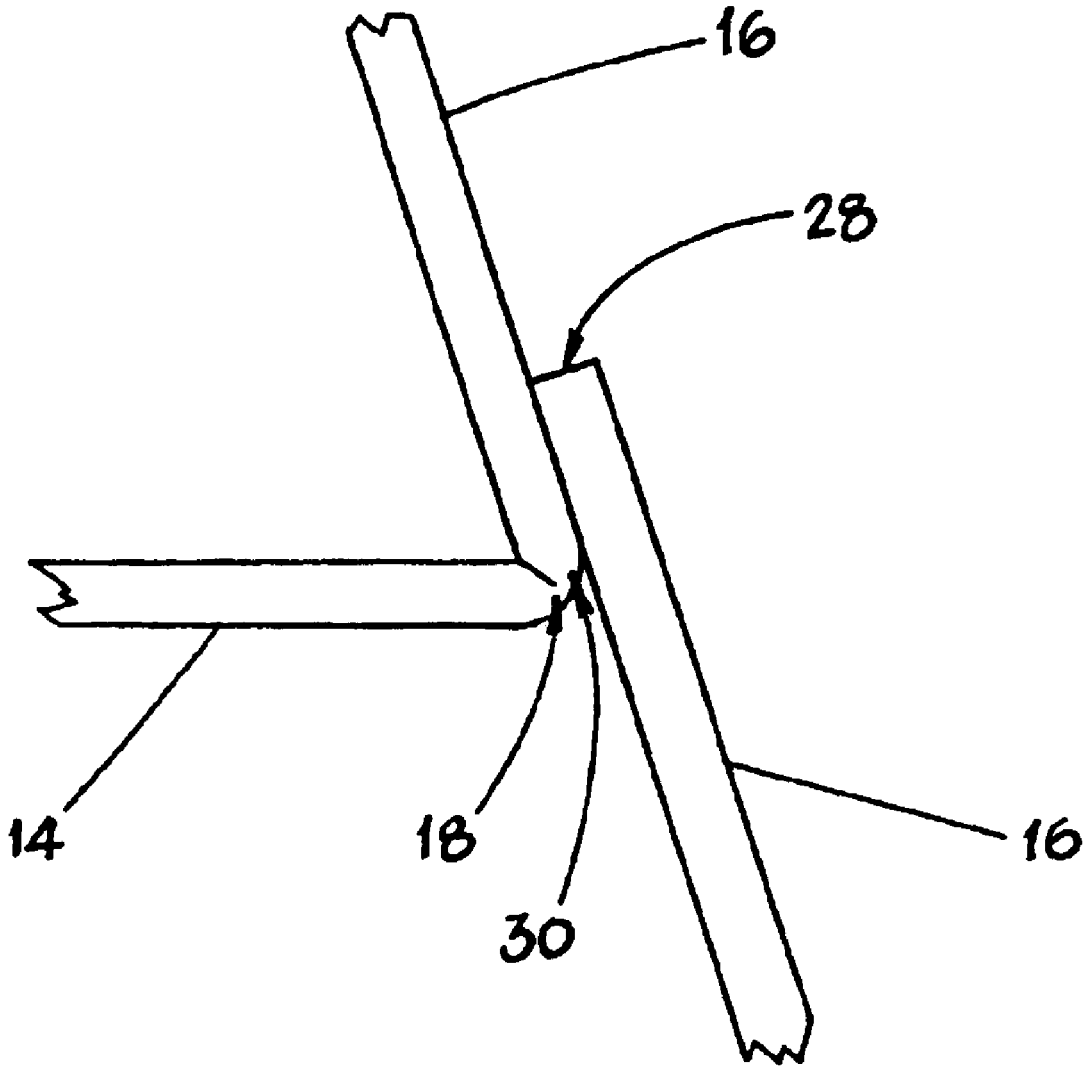
FIG. 10 is a side view of assembling tops and bottoms of wall sections together according to the present invention.
Figure 11:
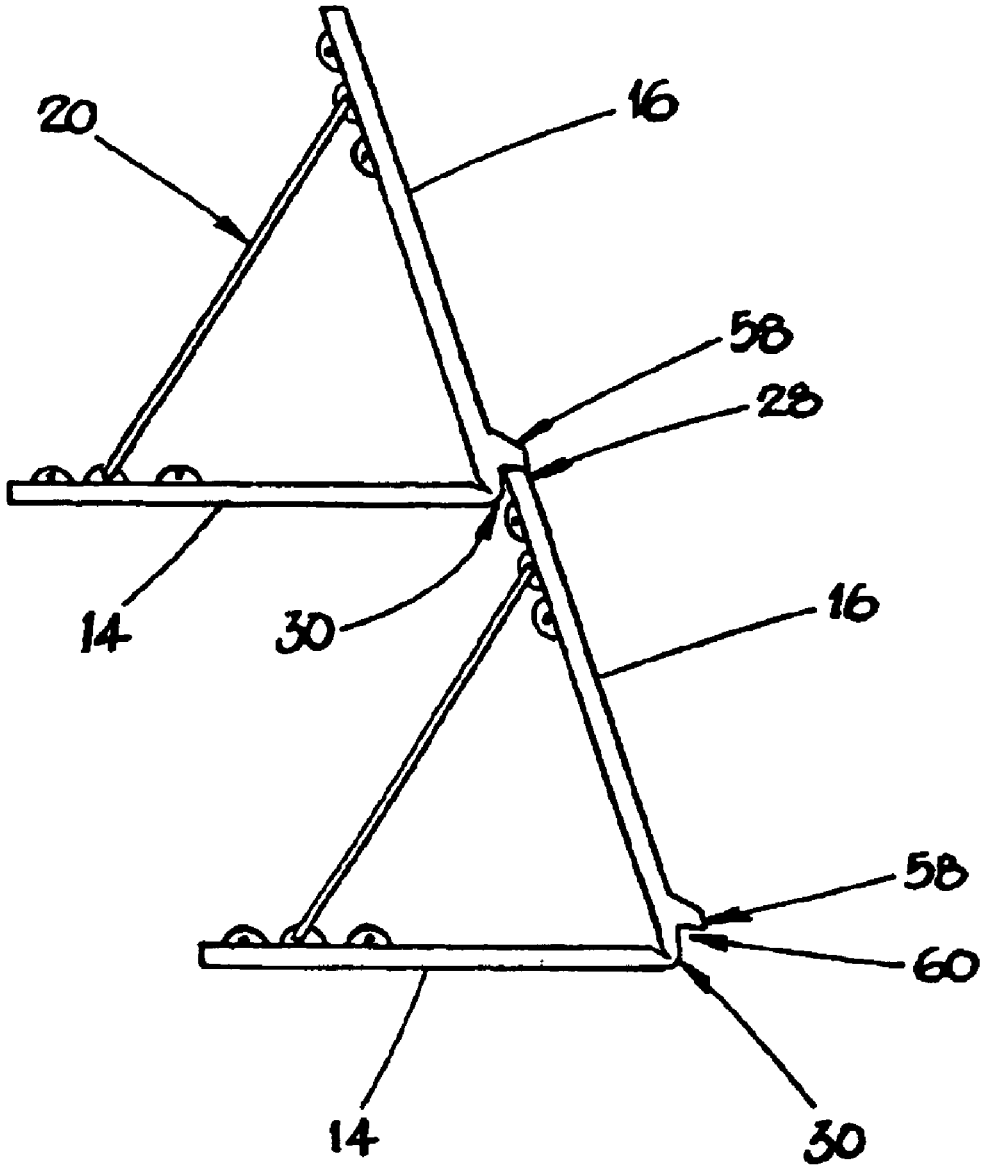
FIG. 11 is a side view of assembling tops and bottoms of wall sections together according to the present invention.

Rows of wall sections 12 can be stacked as shown in FIG. 3. Each row can be added by placing the bases 14 of each additional row on top of the earth between the bases 14 and retaining faces 16 of the row below. As shown in FIGS. 1, 3 and 10, a bottom portion of each retaining face 16 of one row of wall sections 12 can be fastened to a top portion of each retaining face 16 of the row of wall sections 12 below it. As shown more closely in FIG. 10, the front of the bottom 30 of the upper retaining face 16 is laid against the back of the top 28 of the lower retaining face 16. The bottom 30 of the upper retaining face 16 and the top 28 of the lower retaining face 16 can be drilled and fastened together for added strength. Fastening of a wall section 12 to the wall section 12 below can also be done in as shown in FIG. 11. In FIG. 11, the bottom 30 of the retaining faces 16 include a lip 58 that forms a receiving area 60 along the length of the bottom 30 to act as a stop. As shown in FIG. 11, the top 28 of the lower retaining face 16 is placed into the receiving area 60 of the lip 58 of the bottom 30 of the upper retaining face 16.

Figure 12:
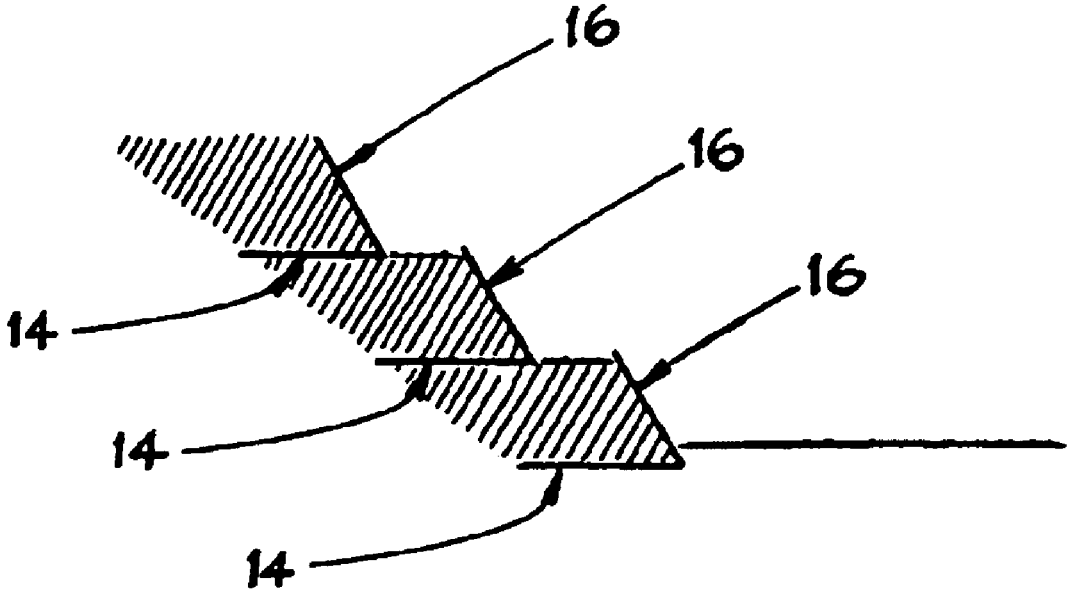
FIG. 12 is a side view of stacking wall sections which include terraces according to the present invention.

Also, each row of wall sections 12 above can be offset from the row below it to make terraces between the rows, as shown in FIG. 12. FIG. 3 shows an anchoring device 38 for additional strength attached to the bases 14 of the wall sections 12. The anchoring device 38 can be a sheet of material attached to the base 14. The anchoring device 38 provides additional strength by holding the wall section 12 in place due to weight of more earth being applied to each wall section 12 and provides overall stability to the embankment. Also, FIGS. 3 and 12 show the first row of wall sections 12 below grade of the soil level to provide support at the bottom of the retaining face 16 to retain the first row of wall sections 12 in position.

The retaining wall system 10 is an improvement of the current conventional practices used for retaining walls, as it is lighter and easier to deploy. The retaining wall system 10 is lighter and easier to ship a higher volume. The retaining wall system 10 has added flexibility in adjustability of the angle of the retaining face 16. Due to the perforated nature of the open grid of the retaining face 16, the retaining face 16 may be finished with a variety of hard materials such as concrete or decorative rock. Also, a layer of top soil may be place behind the retaining face 16, so that plants grow and protrude though the open grid of the retaining face 16, giving the wall a natural appearance. The scope of the invention is not limited to a rectangular shape for the base 14 and retaining face 16 and can be any type of grid pattern.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is :

1. A retaining wall system comprising:

at least one wall section, said at least one wall section comprising:

a base, said base having a front, rear and sides;

a retaining face, said retaining face having a top, bottom and sides;

a hinge connecting said front of said base to said bottom of said retaining face, said hinge allowing said retaining face to be folded to and from said base; and at least one set of a plurality of receiving elements between said sides of both said base and retaining face to allow different angle settings between said base and retaining face; and further including at least one brace for each set of said receiving elements, said brace connected to one of said receiving elements on said base and one of said receiving elements on said retaining face to set an angle between said base and retaining face.

2. The retaining wall system of claim 1, wherein said brace is Z-shaped and said receiving elements are eyelets with holes to receive ends of said brace.

3. A retaining wall system comprising:

at least one wall section, said at least one wall section comprising:

a base, said base having a front, rear and sides;

a retaining face, said retaining face having a top, bottom and sides;

a hinge connecting said front of said base to said bottom of said retaining face, said hinge allowing said retaining face to be folded to and from said base; and said sides of said retaining face include a left side and a right side; wherein said sides of said retaining face include an L-shaped edge, said L-shape edge configured differently on said right side and left side such that when two of said wall sections are assembled side-by-side, the L-shaped edges interlock; wherein said sides each include at least one hole which aligns with each other when two of said wall sections are assembled side-by-side; and further including a fastener par said at least one hole, which is inserted into each of said at least one hole to hold acid assembled sides together.

4. The retaining wall system of claim 3, wherein said fastener is a plug with a flexible tip.

5. A retaining wall system comprising:

at least one wall section, said at least one wall section comprising:

a base, said base having a front, rear and sides;

a retaining face, said retaining face having a top, bottom and sides;

a hinge connecting said front of said base to said bottom of said retaining face, said hinge allowing said retaining face to be folded to and from said base; and wherein said side of said retaining face include a left side and a right side; wherein said sides of said retaining face include an L-shaped edge, said L-shape edge configured differently on said right side and left side such that when two of said wall sections are assembled side-by-side, the L-shaped edges interlock; wherein said sides of said retaining face include a groove along each of said sides of said retaining face; and further including a H-shaped retaining clamp to hold said assembled sides together, said H-shaped retaining clamp including two sides, a cross member between said sides of said H-shaped retaining clamp and locking edges extending from said sides of said H-shaped retaining clamp, said cross member configured to fit between said interlocked L-shaped edges of said assembled sides, and said locking edges configured to lock into said grooves.

6. A retaining wall system comprising:

at least one wall section, said at least one wall section comprising:

a base, said base having a front, rear and sides;

a retaining face, said retaining face having a top, bottom and sides;

a hinge connecting said front of said base to said bottom of said retaining face, said hinge allowing said retaining face to be folded to and from said base; and wherein said retaining face includes a lip near said bottom of said retaining face and a receiving area formed by said lip and said bottom of said retaining face, said receiving area configured to receive a top of said retaining face of another of said wall sections which is positioned below.

7. A retaining wall system comprising:

at least one wall section, said at least one wall section comprising:

a base, said base having a front, rear and sides;

a retaining face, said retaining face having a top, bottom and sides; said retaining face includes an open grid pattern between said top, bottom and sides;

a hinge connecting said front of said base to said bottom of said retaining face, said hinge allowing said retaining face to be folded to and from said base;

at least on set of a plurality of receiving elements between sides of both said base and retaining face to allow different angle settings between said base aid retaining face; and a brace for each of said set of receiving elements, said brace connected to one of said receiving elements on said base and one of said receiving elements on said retaining face to set an angle between said base and retaining face.

8. The retaining wall system of claim 7, wherein said brace is Z-shaped and said receiving elements are eyelets with holes to receive ends of said brace.

9. The retaining wall system of claim 7, further including a sheet of material attached to said rear of said base and extending reward away from said front of said base to act as an anchoring device when covered by a material for retaining said wall sections in place.

10. The retaining wall system of claim 7, wherein said sides of said retaining face include a left side and a right side; wherein said sides of said retaining face include an L-shaped edge, said L-shape edge configure differently on said right side and left side such that when two of said wall sections are assembled side-by-side, the L-shaped edges interlock; wherein said sides each include at least one hole which aligns with each other when two of said wall sections are assembled side-by-side; and further including a fastener per said at least one hole, winch is inserted into each of said at least one hole to hold said assembled sides together.

11. The retaining wall system of claim 10, wherein said fastener is a plug with a flexible tip.

12. The retaining wall system of claim 7, wherein said sides of said retaining face include a left side and a right side; wherein said sides of said retaining face include an L-shaped edge, said L-shape edge configure differently on said right side and left side such that when two of said wall sections are assembled side-by-side, the L-shaped edges interlock; wherein said sides of said retaining face include a groove along each of said sides of said retaining face; and further including a H-shaped retaining clamp to hold said assembled sides together, said H-shaped retaining clamp including two sides, a cross member between said sides of said H-shaped retaining clamp and locking edges extending from said sides of said H-shaped retaining clamp, said cross member configured to fit between said interlocked L-shaped edges of said assembled sides, and said locking edges configured to lock into said grooves.

13. The retaining wall system of claim 7, wherein said retaining face includes a lip near said bottom of said retaining face and a receiving area formed by said lip and said bottom of said retaining face, said receiving area configured to receive a top of said retaining face of another of said wall section which is positioned below.

14. The retaining wall system of claim 7, wherein said open grid pattern includes reinforcing ribs within said open grid pattern.

* * * * *